United States Patent [19]

Gordon et al.

[11] Patent Number: 4,498,585

[45] Date of Patent: Feb. 12, 1985

[54] DENESTING PAPERBOARD CONTAINER

[75] Inventors: Robert L. Gordon, Monroe; Andrew J. Alba, Warwick; Michael Bodary, Middletown; Barbara Mesquida-Feirman, New York, all of N.Y.

[73] Assignee: International Paper Company, New York, N.Y.

[21] Appl. No.: 565,066

[22] Filed: Dec. 23, 1983

[51] Int. Cl.[3] ..... B65D 21/00

[52] U.S. Cl. ..... 206/518; 206/519; 229/17 G

[58] Field of Search ..... 206/499, 515, 516, 518, 206/519, 520; 229/17 G

[56] References Cited

U.S. PATENT DOCUMENTS

| | | | |
|---|---|---|---|
| 1,910,924 | 5/1933 | Klefeker et al. | 206/517 |
| 3,021,990 | 2/1962 | Duskey | 206/519 |
| 3,071,305 | 1/1963 | Zinn | 229/17 |
| 3,094,432 | 6/1963 | Meyer-Jagenberg | 117/63 |
| 3,125,276 | 3/1964 | Zinn | 229/17 |
| 3,217,967 | 11/1965 | Jackson | 229/17 |
| 3,381,883 | 5/1968 | Harris | 229/47 |
| 3,420,397 | 1/1969 | Miller | 206/519 |
| 3,458,110 | 7/1969 | Goldman | 229/17 |
| 3,680,771 | 8/1972 | Blunsdon et al. | 229/65 |
| 3,941,301 | 3/1976 | Jorgensen | 229/14 |
| 4,046,310 | 9/1977 | Gustafsson | 229/30 |
| 4,049,188 | 9/1977 | Persson | 229/14 |
| 4,127,189 | 11/1978 | Shomrak et al. | 206/520 |
| 4,291,828 | 9/1981 | Nigro | 229/41 |
| 4,293,073 | 10/1981 | Yates, Jr. | 206/519 |
| 4,298,156 | 11/1981 | Reifers et al. | 206/519 |
| 4,331,238 | 5/1982 | Hanko et al. | 206/518 |

*Primary Examiner*—Joseph Man-Fu Moy
*Attorney, Agent, or Firm*—Richard J. Ancel

[57] ABSTRACT

A container of generally truncated prismatic form and adapted to hold potable liquids and other foodstuffs. The container is fashioned from a single piece of paperboard coated with a layer of polyethylene on at least one surface and preferably both surfaces. The container is tapered and is closed at its bottom. Prior to filling and subsequent use of the container, the containers may be nested, whereby a single container may be iteratively removed from the nested stack for use. The container is provided with a top sealing, denesting flap which is tacked at spaced portions therealong to define a skirt having bulged segments.

11 Claims, 8 Drawing Figures

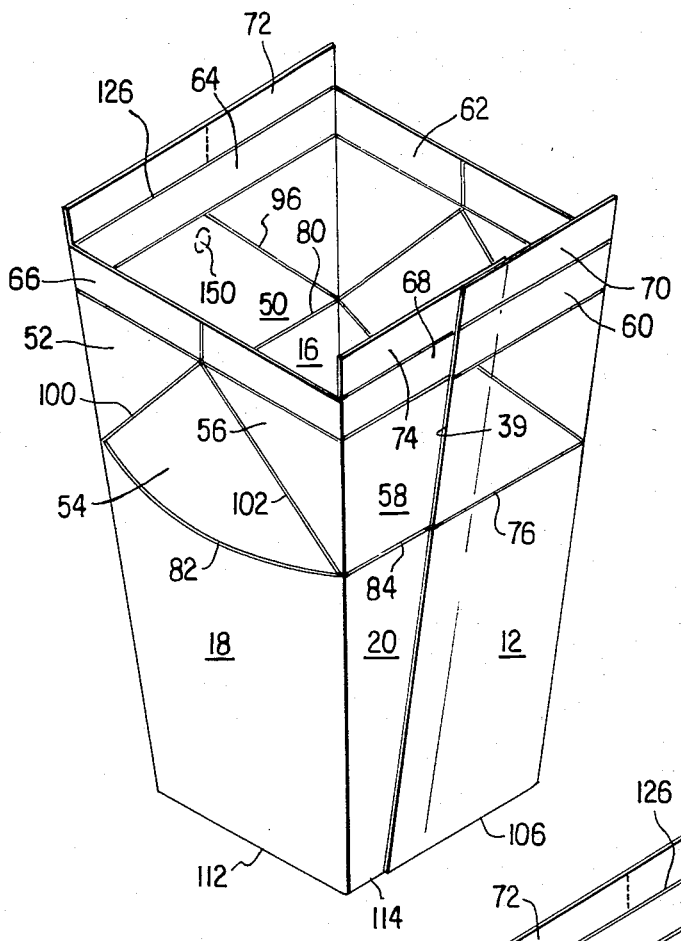
FIG. 2
FIG. 3
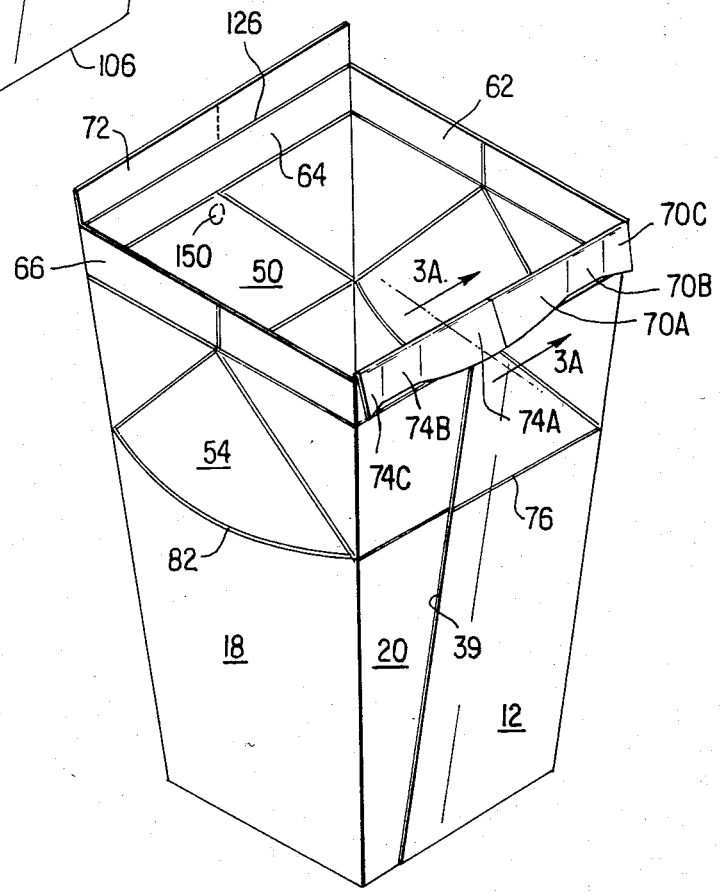
FIG. 3A
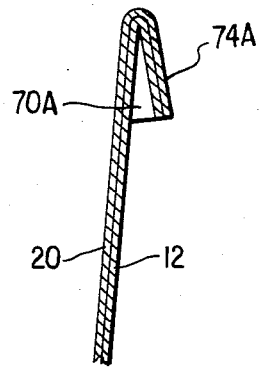

FIG. 3B
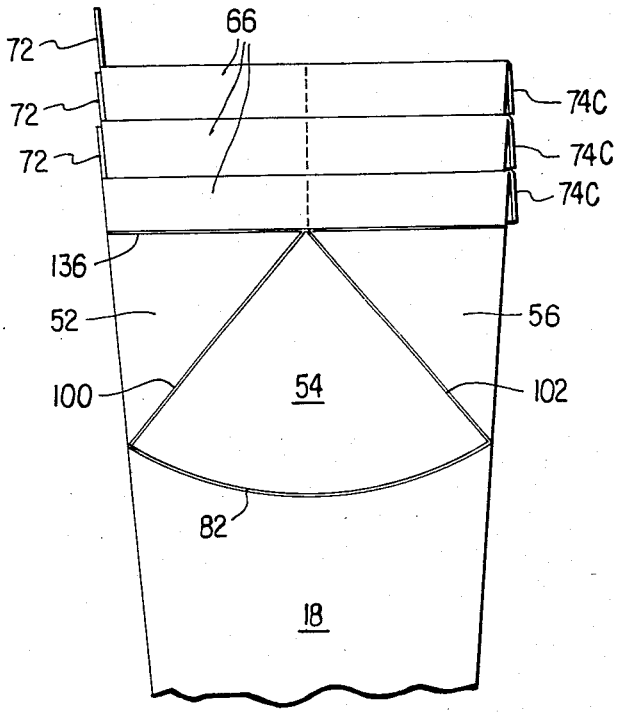
FIG. 4
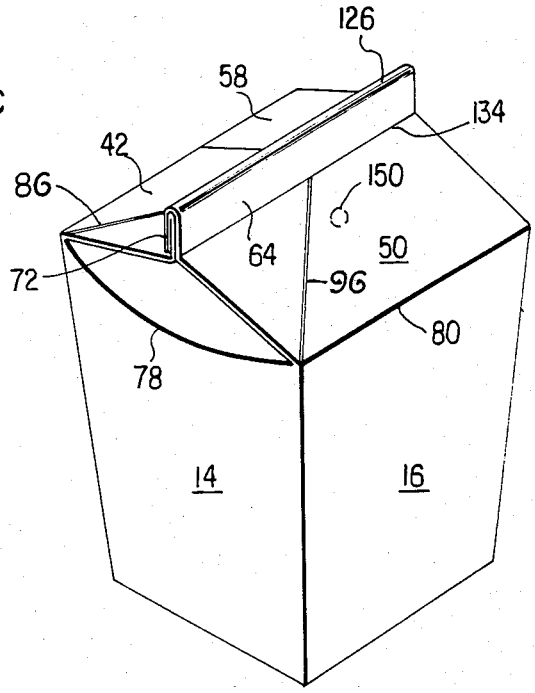
FIG. 5
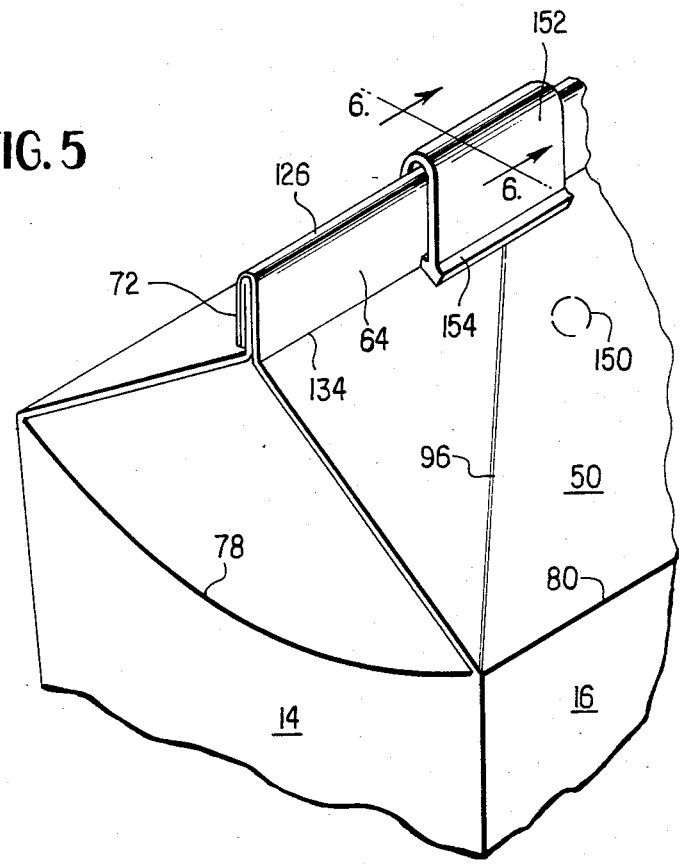
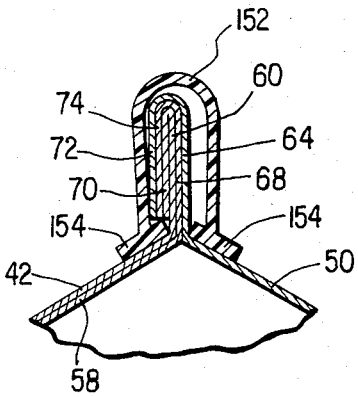
FIG. 6

DENESTING PAPERBOARD CONTAINER

BACKGROUND OF THE INVENTION

This invention relates to a one piece blank and the container formed therefrom, the container exhibiting utility in the packaging of potable liquids and other foodstuffs. The container is of generally truncated, tapered prismatic form and is readily adapted to be erected or set up by automatic machinery.

The containers are similar to the common gable top container presently popular for the packaging of milk and juice. In one manner of top sealing the containers, the same technique and apparatus may be employed as that for the common gable top milk cartons. In another method of closure, a U-shaped clip may be employed, as in the manner illustrated in U.S. Pat. Nos. 3,381,883 issued to Harris, and 3,680,771 issued to Blunsdon.

The containers of this invention display a denesting construction which enables them to be stacked, nested within each other, without locking together. This feature enables the rapid removal of a single container from a stack of nested containers, being assured by this construction that only the single container grasped will be removed from the stack.

The prior art is aware of containers which exhibit denestable constructions. These patents include U.S. Pat. Nos. 1,221,789 issued to Brown, 1,886,171 issued to Dodge et al, 3,941,301 issued to Jorgensen, 4,046,310 issued to Gustafsson, 4,049,188 issued to Persson, and 4,293,073 issued to Yates. It will be understood that these are typical denestable container constructions and do not necessarily represent all of the denestable container constructions of the prior art.

While apparently satisfactory for the containers described in these patents, the denesting construction of this invention is particularly applicable to paperboard containers fashioned from a single blank of paperboard. The paperboard is generally coated on at least that blank surface which will form the inside of the container and usually on both sides with at least a layer of polyethylene, to thereby render the containers impervious to liquids, particularly liquids foodstuffs and potable liquids.

SUMMARY OF THE INVENTION

The specific improvement of the denesting container of this invention resides in the formation of a denesting lip. The lip is formed by folding down a flap or flange extension of a portion of the one-piece blank from which the container is formed. The folded down flap is tacked (adhered) to the wall portion from which it extends by means of a combination of heat and pressure. The tacked portions are spaced from each other. The natural resiliency of the paperboard causes a bulging out of those portions of the folded down flap, so as to define a skirt which bulges except at the flap portions which are tacked. In this manner, no auxiliary lips or stops or abutments are required, the denesting lip being fashioned from the one-piece blank from which the container is fashioned. The invention utilizes the natural resiliency of paperboard to define an overhang or lip which will abut with the upper rim of a container into which a like container is nested or positioned.

The full nature of the invention will be understood from the accompanying drawings and the following description and claims. It should be understood, however, that references in the following description to terms such as top, bottom, and side wall members are for convenience of description, and such terms are not necessarily intended to be used in a limiting sense.

BRIEF DESCRIPTION OF THE DRAWINGS

FIG. 2 is a perspective view of the container of this invention after the initial folding and assembly of the blank of FIG. 1.

FIG. 3 is a view similar to FIG. 2, showing the flap which defines the denesting lip of this invention after having been folded and tacked.

FIG. 3A is a view taken along section 3A—3A of FIG. 3.

FIG. 3B illustrates, in side elevation, three of the denesting containers of this invention in a stacked, non-sticking storage configuration or assembly.

FIG. 4 is a perspective view of the container of FIG. 3 after the container has been filled with a food product and closed, according to one method of closing.

FIG. 5 is a perspective view similar to FIG. 4 showing the container of this invention utilizing a second method of closure.

FIG. 6 is a view taken along section 6—6 of FIG. 5.

DETAILED DESCRIPTION OF THE INVENTION

Figure 1:
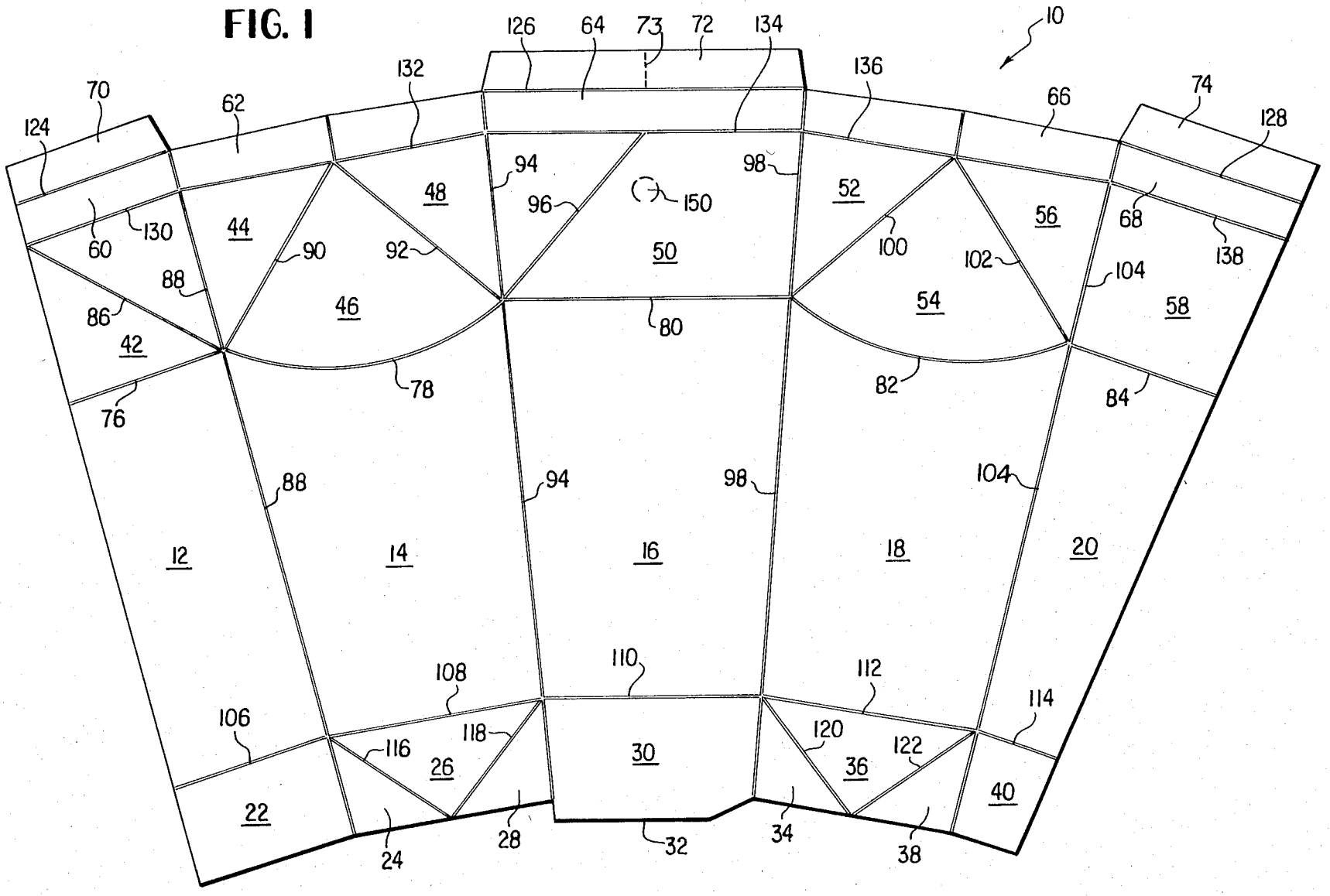
FIG. 1 is a plan view of a one-piece blank from which the container of this invention is fashioned.

Referring now to FIG. 1 of the drawings, the numeral 10 denotes generally a one-piece blank from which the container of this invention is formed. The blank is made of paperboard, coated on at least its container interior forming surface, although preferably on both surfaces, with a layer of thermoplastic material such as polyethylene or another resin that is compatible both as a coating material for paperboard and as being safe for the packaging of foodstuffs. It comprises a first side wall 16 connected at its lower edge along a score line 110 to an outer major bottom closure panel 30 having an extended tuck-in portion 32. First side wall 16 is connected at its upper edge along a score line 80 to an inclined roof panel 50. A second side wall comprises first side panel 12 and second side panel 20, which panels are overlapped in the erected carton to form the second side wall. First side panel 12 and second side panel 20 are connected at their lower edges along score lines 106 and 114, respectively, to first and second major bottom closure panels, 22, 40 respectively. First side panel member 12 and second side panel member 20 are connected at their upper edges along score lines 76, 84, respectively, to first, and second inclined roof members, 42 and 58 respectively.

First end wall 14 and second end wall 18, are each connected along a side edge 94, 98 respectively, to first side wall 16, and each of the first end wall 14 and second end wall 18 is connected along its lower edge along a score line 108, 112 respectively to first minor bottom closure panel 26 and second minor bottom closure panel 36, respectively. First minor bottom closure panel 26 is divided by score lines 116 and 118 into three generally triangular panels 24, 26 and 28. Second minor bottom closure panel 36 is divided by score lines 120 and 122 into three generally triangular panels 34, 36, and 38 respectively. Panels 24, 28 and 34, 38 comprise triangular fold-back panels that flank panels 26 and 28 respectively. Both first end wall 14 and second end wall 18 are connected at their upper edges along arcuate score lines 78 and 82 respectively to first 46 and second 54 in-turned top closure panels, respectively. First 46 and second 54 in-turn d top closure panels are divided by score lines 90, 92, and 100, 102 respectively into three generally triangular panels 44,46, 48 and 52, 54, 56 respectively, panels 44, 48, and 52, 56 comprising triangular fold-back panels, and panels 46 and 54 comprising first and second in-turned triangular end panels. The triangular panels 46, 54 each have an arcuate bottom, the arcuate bottom comprising score lines 78, 82, respectively, which connect each of the triangular end panels 46, 54 to each of the first 14 and second 18 end walls.

Each of the top closure panels 42, 44, 46, 48, 50, 52, 54, 56 and 58 is connected at its upper edge along score lines 130, 132, 134, 136 and 138 respectively to rib panels 60, 62, 64, 66 and 68, respectively, and each of the rib panels 60, 68, which are connected to first 42 and second 58 inclined roof members, are connected along their top edges by score lines 124 and 128, respectively, to first 70 and second 74 side extension flaps or members respectively. Rib panel 64, which is connected to inclined roof panel 50, is connected along score line 126 to first side extension flap or sealing flap 72, the latter provided with perforated line 73.

Each of the first 70 and second side 74 extension members which are connected to the rib panels 60 and 68 respectively, which, in turn, are connected to the first 42 and second 58 inclined roof members, is folded along its score line connection 124, 128, respectively, to the rib panel toward the outside of the container and is tacked at spaced portions therealong to an outside wall of the container. The natural resiliency of the sheet material forming the container causes first 70 and second 74 side extension members to bulge outwardly at their non-tacked portions, to thereby form a denesting lip or skirt, whereby similar containers may be stacked and one container of such a stack may be withdrawn without sticking to the next adjacent container of such stack.

Except for first side panel 12, which is in the form of a rectangle, first end wall 14, second end wall 18, first side wall 16, and second side panel 20 are of generally truncated triangular form, with their longitudinal edge portions being non-parallel, and their top and bottom portions being parallel.

Inclined roof panel 50 is provided with a circular perforated score line 150 which, when ruptured, forms a hole adapted to receive a straw. The numeral 72 denotes the first side extension flap or sealing flap extension of rib panel 64, the extension 72 adapted to form, in cooperation with other side extension members 70 and 74, the closure for the container. Score lines 88, 94, 98 and 104 extend as indicated between panel/wall 12, 14, 16, 18 and 20 and the rib panels 60, 62, 64, 66 and 68. Diagonal score line 86 extends across roof closure panel 42, while slanted score line 96 is provided on roof panel 50. these latter two score lines are adapted to form, when desired, a pour spout.

Referring now to FIG. 2 of the drawings, the carton is shown in a partially assembled configuration, namely, the bottom panels have been folded and sealed together to form a bottom with overlapping portions, in a manner already known in this art.

It will be observed that the top of the container at FIG. 2 is open, the top closure panels that define the container closure not, as yet, having been folded along the indicated score lines. In this same connection, the score lines on the top closure panels may be micro-perforated to provide for ease of folding and opening without spilling the foodstuff or liquid contents of the container. The perforations may extend about half way through the polyethylene interior coating of the blank. This construction is optional and is employed only if the paperboard is too thick to close with ease. From FIG. 2, it will be seen that the container assumes a generally truncated, tapered prismatic form wherein the angle of taper is approximately five degrees. Denesting flap 70, 74 is formed by partially overlapping first and second side extension flaps 70 and 74, while the seam defined by overlapping of the ends of first 12 and second 20 panel members is denoted by the numeral 39.

Referring now to FIG. 3 of the drawings, it will be observed that the container is in the same general form as that of FIG. 2, with the exception of the denesting flap 70, 74 having been bent approximately 180 degrees, so that these overlapped flap portions 70 and 74 which form the denesting flap now are somewhat in parallelism with the wall surface defined first side panel 12 and second side panel 20 of the blank of FIG. 1.

This folding over and operating on portions 70 and 74 results in a denesting lip which will now be described.

The numerals 70A and 74A denote a bulged skirt portion which forms an abutment. The extent of the bulge may be seen by reference to FIGS. 3A and 3B. A pair of tacked portions 70B and 74B are positioned at either side of bulged skirt or abutment lip 70A, 74A. These tacked portions are formed by a combination of heat and pressure, by techniques known in this art. Endmost skirt portions 70C and 74C also bulge or extend outwardly somewhat from the first 12 and second 20 side panels of the container which is formed by overlapping the left and right ends of the blank. The natural resiliency of the paperboard causes the bulge illustrated at FIGS. 3 and 3A. This bulge is accentuated by the double force of the side seam 39. The tacked portions 70B and 74B cause extension flap 70, 74 to adhere to the container side panels 12 and 20 at the tacked portions. At the other folded over portions of 70A, 74B, the natural resiliency of the paperboard causes the skirt to remain in an outwardly flared position, as illustrated.

The container illustrated at FIG. 3 is now ready for use in a nested or stacked array of containers. It will easily be visualized that a container shown at FIG. 3, when placed within a like container in the same orientation, will not travel so far down into the interior of the lower container as to inhibit a later rapid and clean removal of one container of the pair. This may be seen by reference to both FIGS. 3A and 3B. This is also shown, for example, by reference to the noted Brown U.S. Pat. No. 1,221,789 as well as FIG. 4 of the noted Persson U.S. Pat. No. 4,049,188.

In use, nested stacks of the container such as shown at FIG. 3B may be employed in fast food outlets, delicatessens, or other food or beverage outlets wherein single containers taken from a nested stack must be done so readily and without danger of sticking. In this same connection, it will be understood that the invention is not limited to the use of these containers in fast food or other similar environments, but they may be used wherever desired, such as with automated equipment for packaging foodstuffs.

Referring now to FIG. 4 of the drawings, it will be visualized that the container of FIG. 3 may be closed by conventional folding, so as to assume the form illustrated at FIG. 4. Sealing flap 72 is folded over denesting flap 70, 74, after the upper, opposite sides of the container are pushed together, and sealed. This is a conventional heat seal type of closure and is well known in the art and need not be further described.

FIG. 5 illustrates an alternative form of closure which employs a conventional plastic clip 152 having feet 154, one of which is seen, at FIG. 6, to lock under the free edge of denesting flap 70A, 74A to maintain the clip in place. The resiliency of the clip, further, squeezes the overlapping extension portions 126, 70, 74. The clip may be fashioned of a plastic resin using an injection molding process.

The straw hole 150 may be employed for the insertion of a straw in the case where the contents of the container are defined by a potable liquid. Score lines 86 and 96 allow for pouring of the (liquid) contents, similar to that of the conventional gable top type of milk container.

The cartons of this invention may be made in any size, but preferred are 8, 12, 15, 22 and 32 ounce and one liter. The polyethylene layer can vary from 0.5 ml to 1.5 ml in thickness, depending on carton size, and the paperboard from which the blank of FIG. 1 is fashioned is preferably of 14 caliper for the small size cups (up to 15 oz.) and of 16–18 caliper for the larger sizes. The polyethylene is generally extrusion grade low density polyethylene.

Generally speaking, the present invention is directed to a container of generally truncated prismatic form that is adapted to hold potable liquids and other foodstuffs. The container is tapered and is closed at its bottom. A top sealing, denesting flap is provided at the top of one side wall, the denesting flap exhibiting at least one bulge or outwardly extending skirt portion to inhibit sticking of one carton in another when similar cartons are nested. Prior to filling and subsequent closure of the container, the containers are nested, whereby a single container may be iteratively removed from the nested stack for use.

Although the invention has been described above by reference to a preferred embodiment, it will be appreciated that other carton constructions may be devised, which are, nevertheless, within the scope and spirit of the invention and are defined by the claims appended hereto.

What is claimed is:

1. A container fashioned from a single blank of resilient, stiff and foldable sheet material, such as paperboard, the container being in the general form of a truncated, tapered prism, the container having a bottom and having means for forming a top closure, the container adapted to be nested or stacked with like containers, the containers when nested having their top portions still open, a container from the nested stack being withdrawn, filled with a potable liquid or other foodstuff, and then closed at its top, the container having at least one top sealing, denesting flap extension, the flap extension being folded along its base fold line towards the outside of the container and being tacked at spaced portions therealong to an outside wall of the container, the natural resiliency of the sheet material forming the container causing the flap extension to bulge outwardly at its non-tacked portions, to thereby form a denesting lip or skirt, whereby similar containers may be stacked and one container of such a stack may be withdrawn without sticking.

2. The container of claim 1 wherein at least the interior surface is coated with a thermoplastic resin.

3. The container of claim 2 wherein the thermoplastic resin is polyethylene.

4. The container of claim 3 wherein the denesting flap extension is heat tacked to said outside wall of said container.

5. The container of claim 4 wherein said first top side closure panel includes a score line for forming an aperture which is adapted to receive a straw therethrough for access to the contents of the container.

6. A container fashioned from a single blank of resilient, stiff and foldable sheet material, such as paperboard, the container being in the general form of a truncated, tapered prism, the container having a bottom and having means for forming a top closure, the container adapted to be nested or stacked with like containers, the containers when nested having their top portions still open, a container from the nested stack being withdrawn, filled with a potable liquid or other foodstuff, and then closed at its top, said container comprising:

a first side wall connected at its lower edge along a score line to an outer major bottom closure panel having an extended tuck-in member, said first side wall connected at its upper edge along a score line to an inclined roof panel;

a second side wall comprising first and second side panel members which are overlapped in the erected carton, each of said first and second side panel members connected at its lower edge along a score line to first and second major bottom closure panels, each of said first and second side panel members connected at its upper edge along a score line to first and second inclined roof members;

first and second end walls, each connected along a side edge to said first side wall, each said first and second end walls connected along its lower edge along a score line to first and second minor bottom closure panels, each said minor bottom closure panel being divided by score lines into three generally triangular panels, each of said first and second end walls being connected at its upper edge along a score line to first and second in-turned top closure panels, respectively, each said first and second in-turned top closure panels being divided by score lines into three generally triangular panels, two of each three said generally triangular panels comprising triangular fold-back panels, and one of each said three generally triangular panels comprising an in-turned triangular end panel, each said in-turned triangular end panel having an arcuate bottom, said arcuate bottom comprising a score line connecting said triangular end panels to said first and second end walls;

each of said in-turned top closure panels, said inclined roof panels, and said inclined roof members being connected at its upper edge along score lines to rib panels wherein each of the rib panels connected to said first and second inclined roof members are connected along their top edges by score lines to first and second side extension members and said rib panel connected to said inclined roof panel is connected along a score line to a first side extension panel or sealing flap;

wherein each of said first and second side extension members that is connected to said rib panels which are connected to said first and second inclined roof members is folded along its score line connection to said rib panel toward the outside of the container and is tacked at spaced portions therealong to an outside wall of the container, the natural resiliency of the sheet material forming the container causing the first and second side extension members to bulge outwardly at their non-tacked portions, to thereby form a denesting lip or skirt, whereby similar containers may be stacked and one container of such a stack may be withdrawn without sticking to the next adjacent container of such stack.

7. The container of claim 6 wherein at least the interior surface thereof is coated with a thermoplastic resin.

8. The container of claim 7 wherein the thermoplastic resin is polyethylene.

9. The container of claim 8 wherein the denesting flap extension is heat tacked to said outside wall of said container.

10. The container of claim 9 wherein one of said inclined roof panels includes a score line that is adapted to receive a straw therethrough for access to the contents of the container.

11. The container of claim 9 wherein said first and second inclined roof members are each provided with a slanted score line to define means for forming a pour spout when desired.

* * * * *